US007600985B2

(12) United States Patent
Meloche et al.

(10) Patent No.: US 7,600,985 B2
(45) Date of Patent: Oct. 13, 2009

(54) PUMP ASSEMBLY, SUPPRESSION APPARATUS FOR USE WITH A PUMP, AND METHOD OF CONTROLLING A PUMP ASSEMBLY

(75) Inventors: Joseph L. Meloche, Rochester Hills, MI (US); Stephen D. Able, Bethlehem, PA (US); Jana Able, legal representative, Bethlehem, PA (US)

(73) Assignee: Ingersoll-Rand Company, Montvale, NJ (US)

( * ) Notice: Subject to any disclaimer, the term of this patent is extended or adjusted under 35 U.S.C. 154(b) by 470 days.

(21) Appl. No.: 10/976,007

(22) Filed: Oct. 28, 2004

(65) Prior Publication Data

US 2007/0065304 A1 Mar. 22, 2007

(51) Int. Cl.
*F04B 43/06* (2006.01)
*F04B 53/16* (2006.01)

(52) U.S. Cl. ..... 417/395; 417/312; 417/443

(58) Field of Classification Search ..... 417/312, 417/395, 443, 397, 413; 335/258
See application file for complete search history.

(56) References Cited

U.S. PATENT DOCUMENTS

| | | | | |
|---|---|---|---|---|
| 5,492,451 | A * | 2/1996 | Franz et al. | 417/312 |
| 6,168,394 | B1 * | 1/2001 | Forman et al. | 417/395 |
| 6,280,149 | B1 | 8/2001 | Able et al. | |
| 6,846,161 | B2 * | 1/2005 | Kline et al. | 417/46 |
| 7,374,409 | B2 * | 5/2008 | Kawamura | 417/472 |

* cited by examiner

*Primary Examiner*—Charles G Freay
*Assistant Examiner*—Patrick Hamo
(74) *Attorney, Agent, or Firm*—Michael Best & Friedrich LLP

(57) ABSTRACT

A pump assembly comprising an apparatus for reducing process noise manifest in a piping system. The invention introduces a pump pulse to counteract a negative dip in pressure when the reciprocating pump is at the completion of each pump stroke.

7 Claims, 8 Drawing Sheets

LEFT
PUMP
RIGHT
PUMP
LEFT
PUMP
100
0
DISCHARGE
PRESSURE (PSI)
t
t
LEFT
RIGHT
CONNECTING
ROD POSITION

PUMP ASSEMBLY, SUPPRESSION APPARATUS FOR USE WITH A PUMP, AND METHOD OF CONTROLLING A PUMP ASSEMBLY

FIELD OF THE INVENTION

The invention relates to a reciprocating pump assembly, a noise suppression apparatus for use with a reciprocating pump, and a method of controlling a reciprocating pump assembly.

BACKGROUND

One of the most common air-operated pumps used in industry is a double-diaphragm, positive displacement type shown in FIG. 1. This type of pump is self-priming and displaces fluid from one of its two liquid chambers upon each stroke completion. Only several parts contact the fluid, two diaphragms which are connected by a common connecting rod, two inlet valve balls, and two discharge valve balls. The diaphragms act as a separation membrane between the compressed air supply operating the pump (air chamber) and the liquid (fluid chamber). Driving the diaphragms with compressed air instead of the connecting rod balances the load on the diaphragm, which removes mechanical stress and extends diaphragm life. The valve balls open and close on valve seats to direct liquid flow. When each diaphragm has gone through one suction and one discharge stroke, one pumping cycle has taken place. An air distribution system is part of the pump and switches the common air supply for the pump from one air chamber to the second air chamber as each fluid chamber empties at the end of its respective stroke.

The air distribution system shifts the symmetric pumping action in order to create suction and discharge strokes. When the diaphragms have traveled a maximum excursion in one direction, a mechanical pilot valve is typically actuated, shifting a main valve, and reversing the pneumatic action. The other air chamber is then pressurized to expel its fluid and the device continues this reciprocation until the air supply is stopped. Various pump manufacturers accomplish the air distribution using purely mechanical valve assemblies and/or valve assemblies that are electrically controlled.

The discharge of a double-diaphragm, reciprocating pump is dependent only on the mechanical characteristics of the air distribution system and the fluid dynamics of the pump itself. Shown in FIG. 2 is a typical discharge pressure versus time plot of a prior art, dual-diaphragm, air-operated pump. FIG. 3 shows the corresponding plot of the air distribution system connecting rod excursion in time, as the rod travels in the direction of one diaphragm pump, arbitrarily denoted as left, then to the other diaphragm pump, arbitrarily denoted as right. As the diaphragms complete their travel in one direction and reverse direction, a large pressure dip occurs when the connecting rod is at the excursion limit. This is due to the inherent pressure change when transitioning between suction and discharge strokes. The output results in a series of pulses or surges corresponding with each diaphragm pump stroke. In the control systems art, these surges manifest in the process piping are referred to as process noise. All pumps operating with some type of reciprocation produce process noise.

To reduce unwanted fluctuation, passive external pulsation dampeners can be added downstream of the pump. The prior art dampener shown in FIG. 4 contains a pressure regulator and a pressurized diaphragm acting as an accumulator. The diaphragm traps a given volume of liquid on one side and pressurized air on the other. When the fluid pressure falls in the system, the dampener supplies additional pressure to the discharge line between pump strokes by displacing fluid by the diaphragm movement. This movement provides a supplementary pumping action needed to minimize pressure variation and pulsation. Most dampeners set and maintain air pressure to match the variations in the liquid flow or discharge pressure generated by the pump. A shaft attached to the diaphragm and pressure regulator triggers the addition or deletion of the air within the air chamber side of the dampener. The dampener reacts to pressure and/or flow settings of the pump with no need for manual adjustment.

However, the prior art external pulsation dampeners are large and require additional support, making them costly to purchase and install. By their passive nature, these dampeners are slow to react and process noise is still introduced into the system as shown in FIG. 5.

What is needed is a low cost, active suppression device to anticipate and cancel process noise produced by reciprocating pumps thereby reducing water hammer and strain on equipment coupled downstream.

SUMMARY

The invention provides, in one embodiment, an apparatus for canceling process noise introduced by a reciprocating pump. In one construction, the apparatus includes a controller corresponding with a reciprocating pump connecting rod, the controller adapted to output a signal during each connecting rod excursion. The signal is coupled to a solenoid valve, which opens to admit an air supply to operate a pulse pump having a discharge coupled to the reciprocating pump discharge. The pulse pump ejects a predefined quantity of fluid when the solenoid valve is opened.

In another embodiment, the invention provides a rate sensor adapted to receive inputs from a reciprocating pump and output a signal representative of device rate to a controller. The controller processes the device rate signal as process noise manifest by the reciprocating pump and outputs an anti-noise signal to a pulse pump whereby the anti-noise signal is an inverted replica of the device noise. The pulse pump output is coupled to the reciprocating pump discharge and outputs a pressure profile corresponding to the anti-noise signal thereby canceling the process noise manifest by the pump.

Other features and advantages of the invention will become apparent to those skilled in the art upon review of the following detailed description, claims, and drawings.

DETAILED DESCRIPTION

Before any aspects of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
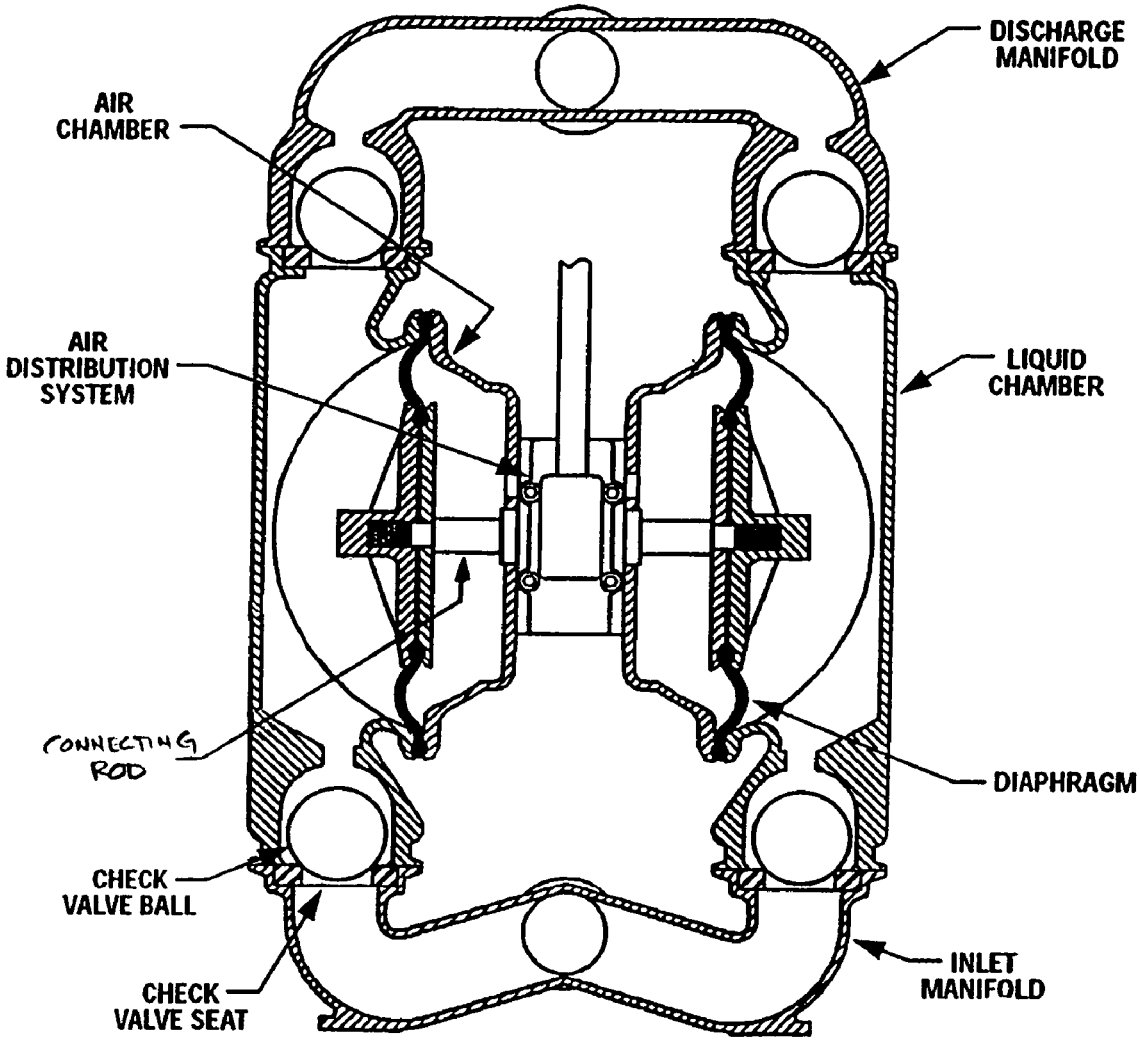
FIG. 1 PRIOR ART
FIG. 1 is a front, section view of a prior art double-diaphragm, reciprocating pump.
Figures 2, 3:
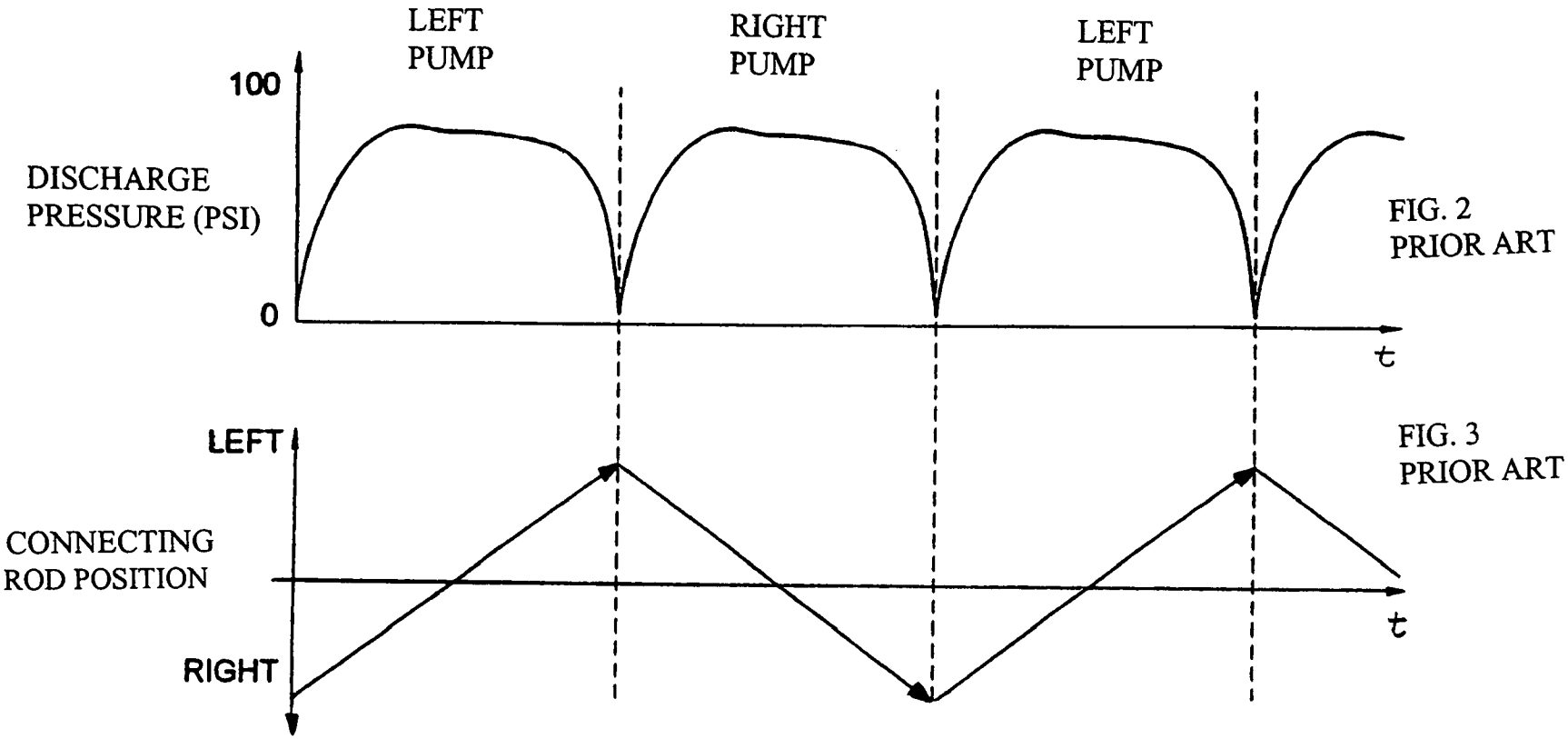
FIG. 2 PRIOR ART
FIG. 3 PRIOR ART
FIG. 2 is a plot of discharge pressure versus time for the pump shown in FIG. 1.
FIG. 3 is a plot of connecting rod excursion versus time for the pump shown in FIG. 1.
Figure 4:
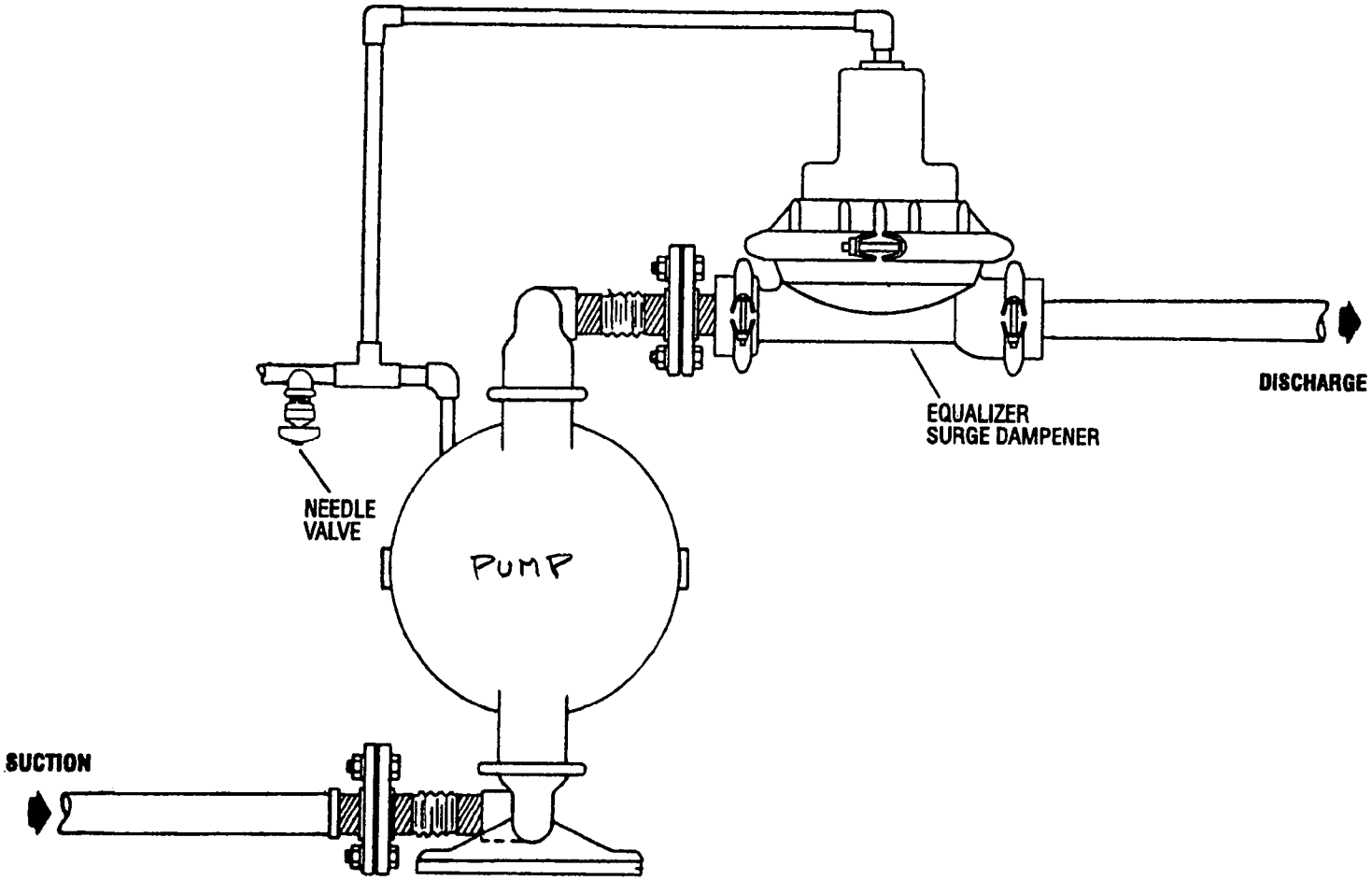
FIG. 4 PRIOR ART
FIG. 4 shows a prior art surge dampener coupled downstream of a double-diaphragm, reciprocating pump.
Figure 5:
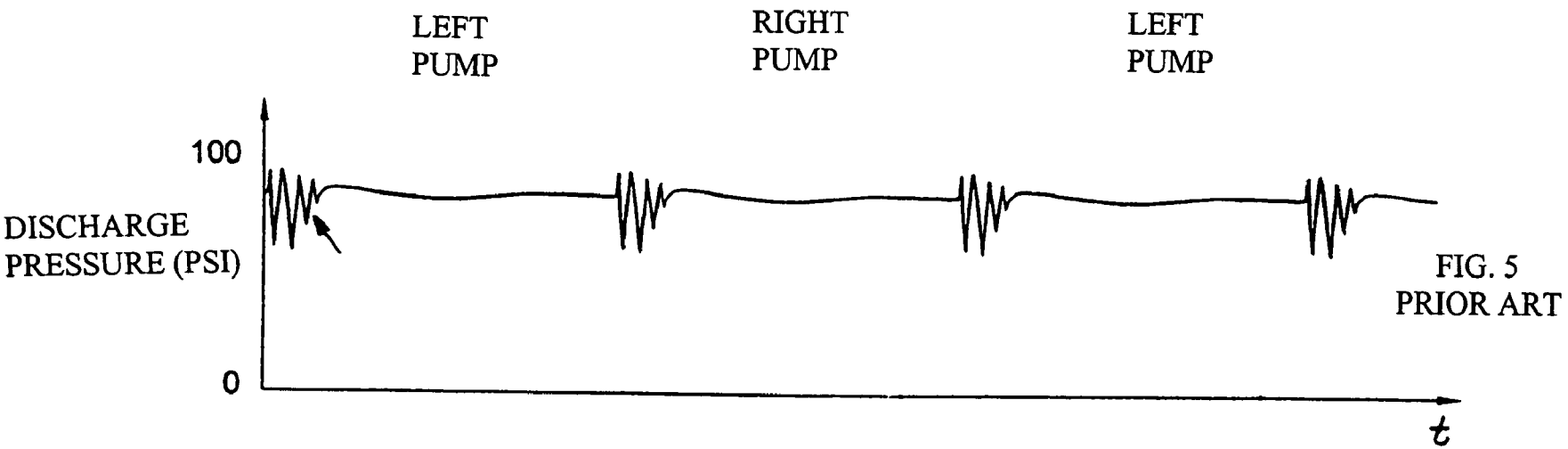
FIG. 5 PRIOR ART
FIG. 5 is a plot of discharge pressure versus time with the surge dampener of FIG. 4.
Figure 6:
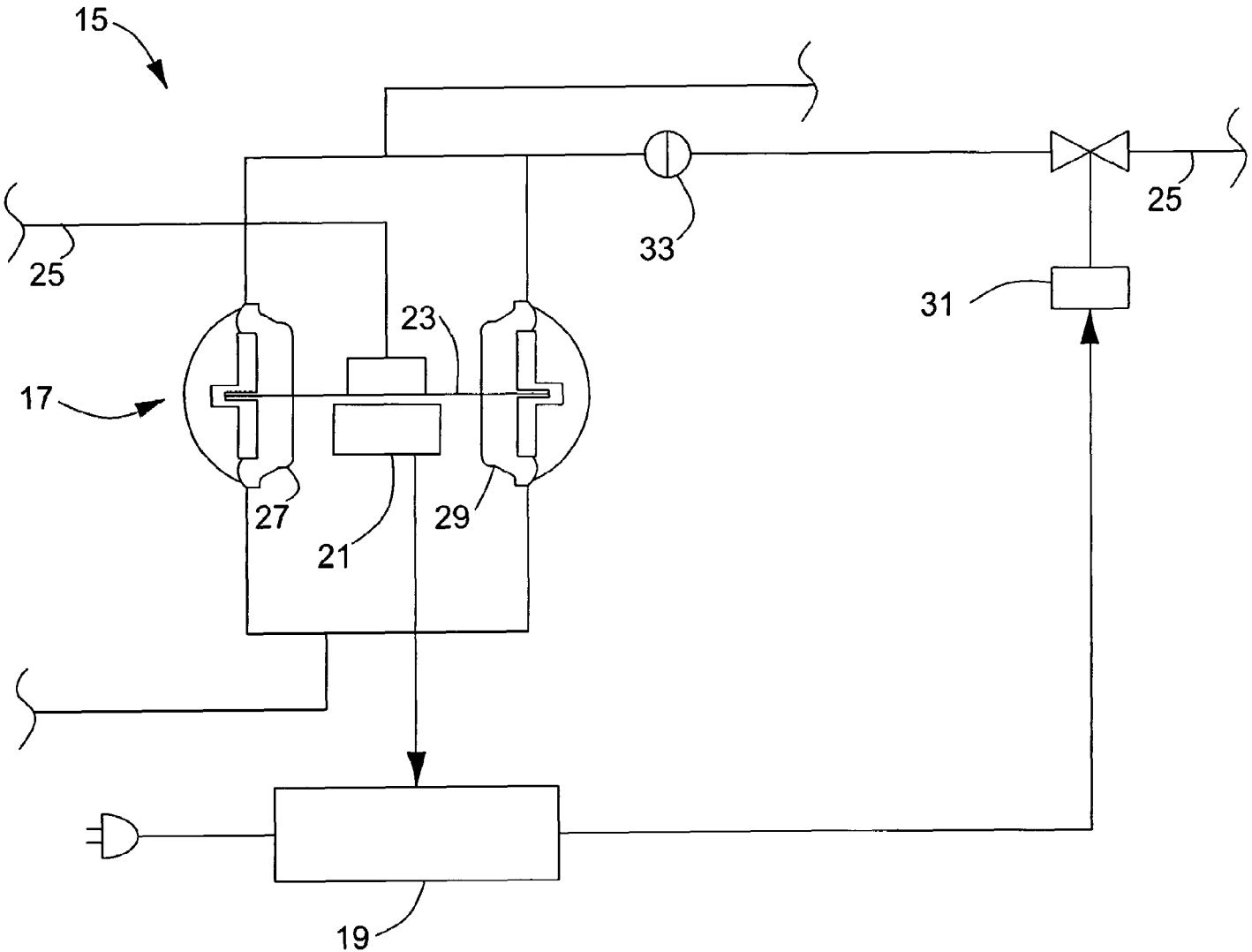
FIG. 6 is a schematic diagram of a double-diaphragm, reciprocating pump assembly incorporating the invention.
Figure 7:
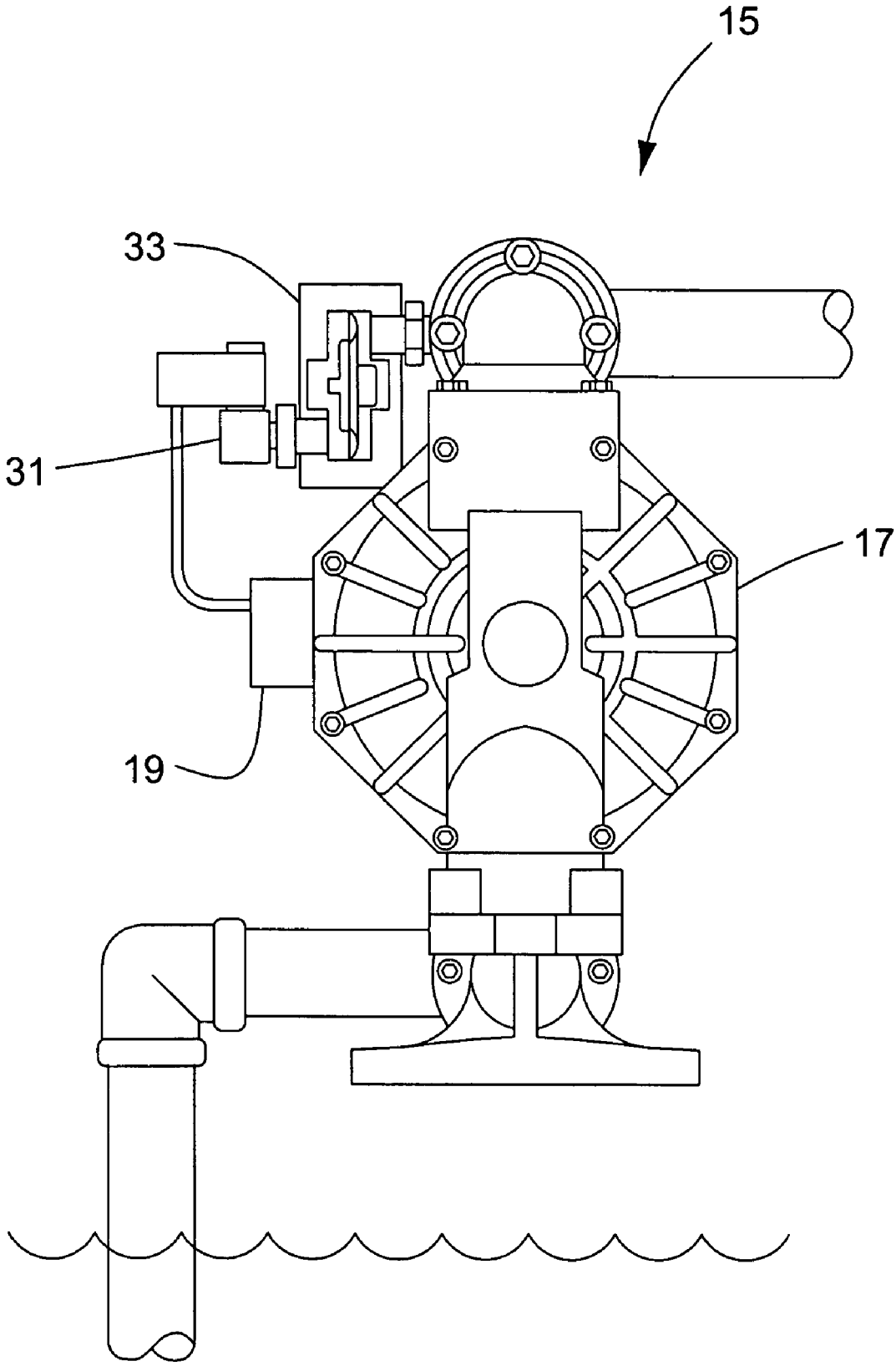
FIG. 7 shows the physical application of the pump assembly of FIG. 6.

Shown in FIGS. 6 and 7 are schematic and physical diagrams of one construction of a double-diaphragm, reciprocating pump assembly. Before proceeding further, it should be noted that while a double-diaphragm, air operated pump is shown for FIGS. 6 and 7, the invention may be used with other types of reciprocating pumps regardless of the motive power.

By way of background, the examination of process noise is typically performed in the frequency domain. Namely, how the noise energy is distributed as a function of frequency. Turbulent noises distribute their energy evenly across the frequency bands and are referred to as broadband noise. Narrow band noise energy is concentrated at specific frequencies. When the source of noise is a rotating or repetitive machine, the noise frequencies are all multiples, or harmonics, of a basic noise cycle. This type of noise can be classified as periodic, along with a smaller amount of broadband noise and is common in man-made machinery. Examples of sources of narrow band noise include internal combustion engines, compressors, power transformers and pumps.

Shown in FIG. 6 is an assembly 15 arranged to cancel the noise manifest in process piping by an air-operated, reciprocating pump 17. The assembly 15 includes a controller 19 and connecting rod position transducer 21 mounted adjacent to a connecting rod 23 of the air-operated, reciprocating pump 17. The pump 17 receives its motive power from a common air supply 25.

The connecting rod position transducer 21 corresponds with the common connecting rod 23 coupling each diaphragm 27, 29 on the pump 17. The transducer 21 monitors the excursion of the connecting rod 23 using a sensor. The sensor can be reed, proximity, or other equivalent limit switch types. The sensor can also be a linear displacement device such as a digital gauging probe, a linear variable differential transformer (LVDT), a hybrid micro-electromechanical system (MEMS), or other like equivalents. The linear displacement sensor similarly corresponds with the connecting rod. The rod position transducer 21 output is communicated to the controller 19.

As the connecting rod 23 nears its excursion limits at each end of travel, a signal based on the connecting rod 23 location is output from the controller 19 to a solenoid valve 31. The solenoid valve 31 controls the air supply 25 to a pulse pump 33. Upon energization, the solenoid valve 31 opens, admitting air to the pulse pump 33. The pulse pump 33 has a predefined volume on a fluid side of a diaphragm, which is ejected, into the pump 17 discharge.

Figure 8:
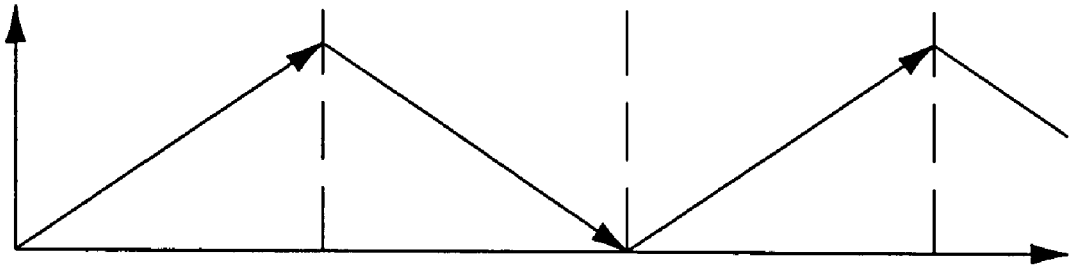
FIG. 8 is a plot of connecting rod excursion versus time for the pump assembly of FIG. 6.
Figure 9:
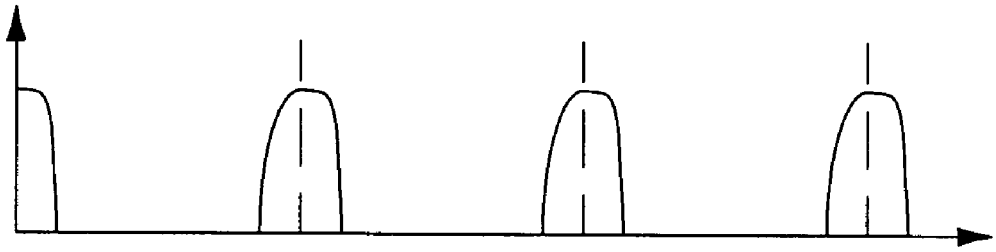
FIG. 9 is a plot of pulse pump discharge pressure versus time.
Figure 10:
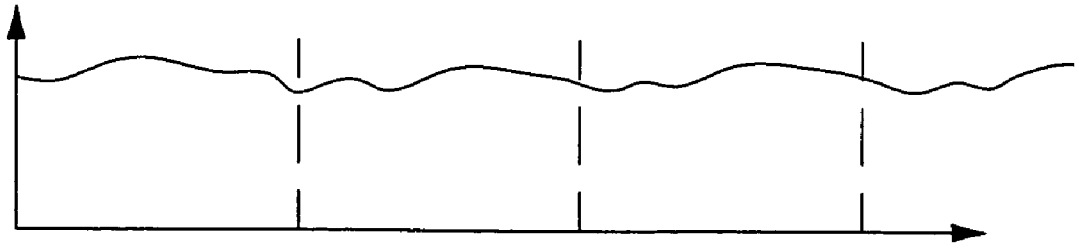
FIG. 10 is a plot of discharge pressure versus time for the pump assembly of FIG. 6.

Shown in FIGS. 8 and 9 is the timing of the solenoid valve 31 openings and the output pressure response of the pulse pump 33 respectively. The pulse pump 33 discharges before the excursion limits are reached by the connecting rod 23 to allow the fluid inertia to produce a positive pressure in the pump discharge and cancel the pump 17 pressure dips as shown in FIG. 10.

The assembly 15 allows for either maintaining, advancing, or retarding pulse pump 33 operation depending upon speed of the pump 17. The controller 19 monitors the connecting rod 23 position via the rod position transducer 21 and, by counting the cycles per unit time, arrives at pump 17 speed and discharge volume. The operation of the pulse pump 33 is timed during the connecting rod 23 excursion to maximize noise suppression. At slow pumping speeds, pulse pump 33 actuation is retarded, occurring later during the connecting rod 23 excursion. At faster speeds, pulse pump 33 actuation is advanced, occurring earlier during the excursion.

In an alternative construction, the assembly 15B reduces reciprocating pump 17 process noise by generating a canceling, anti-noise signal, which is an inverted replica (180° out of phase) of the noise manifest in the process line. The anti-noise signal is then introduced into the noise environment via the pulse pump 33. The two noise signals cancel each other out, effectively removing a significant portion of the noise energy from the process.

Figure 11:
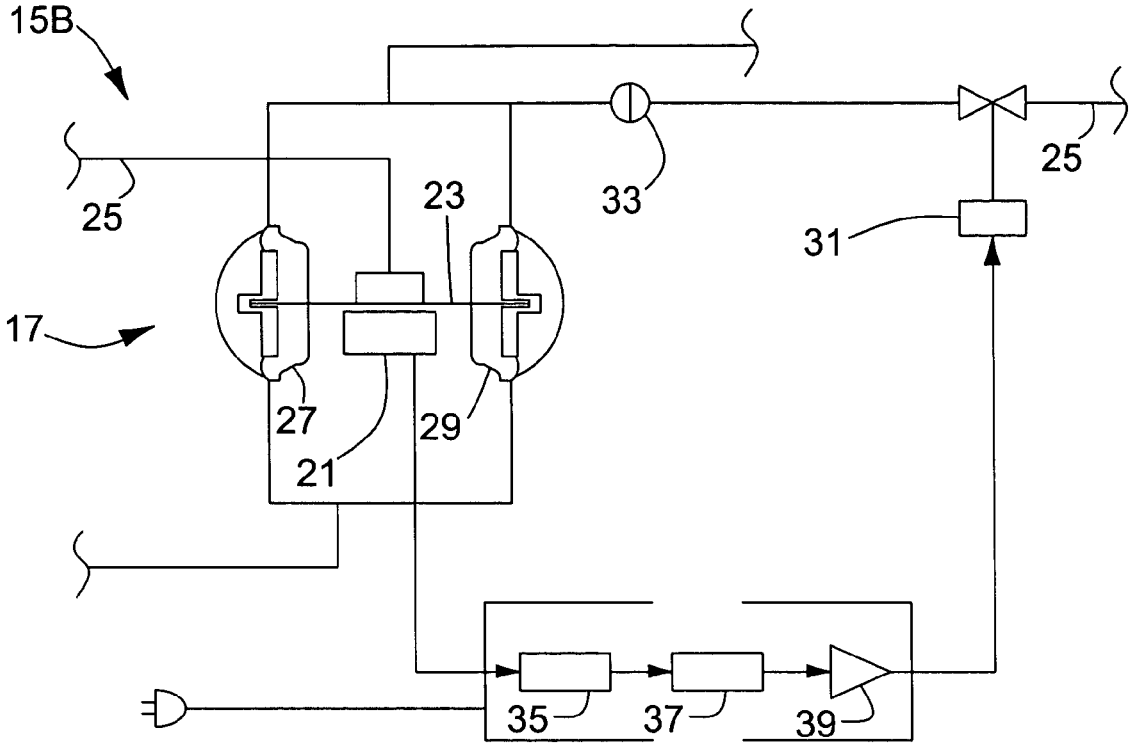
FIG. 11 is a schematic diagram of an alternative construction of the double-diaphragm, reciprocating pump assembly incorporating the invention.

The technique of synchronous feedback is effective on repetitive noise. An input signal is used to provide information on the rate of the noise. Since all of the repetitive noise energy is at harmonics of the pump cyclical rate, a digital signal processor can cancel the known noise frequencies. Digital signal processors (DSPs) perform the calculations involved in noise cancellation. The use of DSPs makes it feasible to apply active noise cancellation to problems in low frequency noise at a reasonable cost. FIG. 11 shows active noise cancellation applied to the assembly 15B to reduce the process noise attributed to pump discharge pulsing. The active element is the pulse pump 33. The pulse pump 33 outputs an anti-noise pulse to the pump 17 discharge. The process noise profile and anti-noise provides for global cancellation of the low frequency process noise.

The connecting rod transducer 21 outputs a signal representative of pumping rate. The signal is coupled to a generator 35 to internally provide frequencies at the harmonics of the pump 17 rate. The rate is modeled by the connecting rod travel 23 (excursion) versus time. The excursion establishes the fundamental frequency of the noise and any acceleration or deceleration the connecting rod 23 may experience during each stroke.

The generator 35 artificially models the noise estimate. The noise estimate is output and coupled to the input of a programmable filter 37 such as a finite impulse response filter (FIR). Other embodiments may use infinite impulse, Kalman, or equivalent filter structures. The filter 37 builds a mathematical representation of the noise estimate having a gain equal to the noise and a phase shift of 180°. The output is a new signal approximating the expected noise in the process. The new signal is used to cancel the noise and is the basic tenet of feed forward control.

The cancellation signal is amplified 39 and output to a modulating valve 31 for transducing the cancellation signal to air pressure for operating the pulse pump 33. The operation of the pulse pump 33 cancels the narrowband noise effects of the mechanical pumping cycle.

Figure 12:
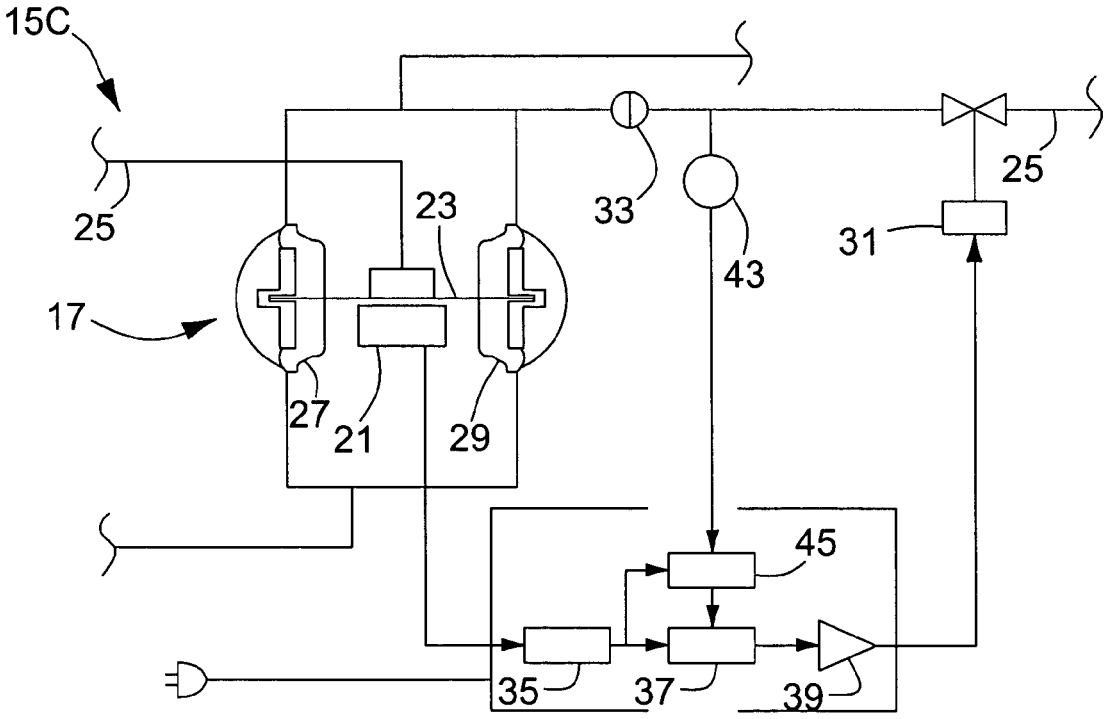
FIG. 12 is a schematic diagram of another alternative construction of the double-diaphragm, reciprocating pump assembly incorporating the invention.

Another alternative construction of the assembly 15C having a feed forward control system is shown in FIG. 12. The assembly 15C further includes an adaptation scheme to adapt the programmable filter 37 to further minimize error. Considering the importance of gain and phase matching in feedforward control, this variant implements adaptive algorithms such as a least mean square (LMS) algorithm to minimize errors in these parameters based on minimizing the mean square of the disturbance response. Other schemes such as a filtered-x least mean square (FxLMS) algorithm may be used. A pressure sensor 43 in the discharge of the pulse pump 33 feeds back noise remaining after cancellation to an adapter 45. The adapter 45, using an LMS adaptation algorithm, continuously adjusts the cancellation filter 37 to drive any remaining process noise to zero.

Accordingly, the invention provides new and useful pump assemblies, suppression apparatus for use with a pump, and methods of controlling a pump assembly. Various other features and advantages of the invention are set forth in the following claims.

What is claimed is:

1. A method of controlling a reciprocating pump assembly and a noise cancellation system coupled to the reciprocating pump assembly, the reciprocating pump assembly comprising a fluid suction, a reciprocation member, and a fluid discharge, the method comprising: acquiring a first signal having a relation to the excursion of the reciprocating member; producing a second signal during each excursion of the reciprocating member; delivering a defined volume of fluid to the fluid discharge based on the second signal, wherein producing the second signal comprises approximating the expected noise of the reciprocating pump assembly and outputting a cancellation signal, wherein the cancellation signal is based upon the expected noise and phase-shifted from the expected noise, wherein the cancellation signal substantially cancels out the second signal.

2. A method as set forth in claim 1 wherein the reciprocating pump comprises a double-diaphragm, reciprocating pump, and wherein the reciprocating member comprises a connecting rod coupling a first diaphragm to a second diaphragm.

3. A method as set forth in claim 1 wherein the noise cancellation system comprises a solenoid and a pulse pump coupled to the solenoid, and wherein delivering a defined volume of fluid to the fluid discharge comprises controlling an air supply to the pulse pump based on the second signal, and delivering the defined volume of fluid in response to the controlling of the air supply to the pulse pump.

4. A method as set forth in claim 1 wherein the first signal is a signal having a relation to the position of the reciprocating member.

5. A method as set forth in claim 1 wherein the first signal is representative of a pumping rate of the reciprocating pump assembly.

6. A method of controlling a reciprocating pump assembly and a noise cancellation system coupled to the reciprocating pump assembly, the reciprocating pump assembly comprising a fluid suction, a reciprocation member, and a fluid discharge, the method comprising: acquiring a first signal based upon the excursion of the reciprocating member; producing a second signal during each excursion of the reciprocating member; delivering a defined volume of fluid to the fluid discharge based on the second signal, wherein producing the second signal comprises modeling a noise of the reciprocating pump assembly, filtering the modeled noise, and outputting a cancellation signal based upon the filtered noise, wherein the cancellation signal substantially cancels out the second signal.

7. A method as set forth in claim 6 and further comprising acquiring a pressure having a relation to the discharged fluid, and wherein producing the second signal further comprises determining an error based on the acquired pressure, and adapting the filter based on the error.

* * * * *

UNITED STATES PATENT AND TRADEMARK OFFICE

CERTIFICATE OF CORRECTION

PATENT NO. : 7,600,985 B2
APPLICATION NO. : 10/976007
DATED : October 13, 2009
INVENTOR(S) : Meloche et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1044 days.

Signed and Sealed this

Fifth Day of October, 2010

David J. Kappos

David J. Kappos
*Director of the United States Patent and Trademark Office*